US006325224B1

(12) United States Patent
Brown

(10) Patent No.: US 6,325,224 B1
(45) Date of Patent: Dec. 4, 2001

(54) STACKABLE TRANSPORT PALLET

(75) Inventor: James Stephen Brown, Birmingham, AL (US)

(73) Assignee: Tubular Products Company, Inc., Birmingham, AL (US)

( * ) Notice: Subject to any disclaimer, the term of this patent is extended or adjusted under 35 U.S.C. 154(b) by 0 days.

(21) Appl. No.: 09/717,545

(22) Filed: Nov. 21, 2000

(51) Int. Cl.[7] ..... A47F 5/00

(52) U.S. Cl. ..... 211/194; 211/195; 108/53.1; 108/56.1; 410/4

(58) Field of Search ..... 211/194, 195, 211/13.1, 85.8; 108/51.11, 53.1, 56.1, 57.31; 410/4

(56) References Cited

U.S. PATENT DOCUMENTS 2,906,405 * 9/1959 Erickson .
2,956,763 * 10/1960 D'Arca .
3,620,388 * 11/1971 Mansson ..... 108/56.1 X
3,664,273 * 5/1972 Howe .
4,307,985 12/1981 Desprez et al. .
4,722,503 * 2/1988 Monahan ..... 211/182 X
4,966,085 * 10/1990 Howe ..... 108/56.1 X
5,644,991 7/1997 Prevot et al. .
5,644,992 * 7/1997 Clive-Smith ..... 108/53.1 X
5,692,625 * 12/1997 Filipescu et al. ..... 211/195
5,983,806 11/1999 Brennan, Jr. et al. .

* cited by examiner

*Primary Examiner*—Robert W Gibson, Jr.
(74) *Attorney, Agent, or Firm*—Christopher A. Holland; Robert J. Veal; Burr & Forman LLP

(57) ABSTRACT

A stackable transport pallet comprising a planar support member having a substantially cloverleaf shape. The planar support member includes a first and second wide frame member and a first and second narrow frame member that are joined together to form the cloverleaf shape. A pair of lateral bumpers and a pair of longitudinal bumpers are additionally connected to the planar support member, such that the lateral and longitudinal bumpers will provide a distance between the planar support member and the ground surface. The stackable transport pallet includes a set of braces that are operable to support a vehicle or other item being stored on the stackable transport pallet. In addition, a set of leg assemblies are also attached to the planar support member to allow the pallet to be stackable. The leg assemblies are pivotable between an extended and a retracted position. In the extended position, cargo may be loaded on the planar support member and stacked accordingly. In contrast, when the leg assemblies are in the retracted position, the stackable transport pallets are easily shipped to a desired destination.

17 Claims, 9 Drawing Sheets

STACKABLE TRANSPORT PALLET

FIELD OF THE INVENTION

The present invention relates to a pallet for storing and transporting goods. More specifically, the present invention relates to a pallet for storing and transporting vehicular cargo, with the pallet being stackable in either an extended position with the vehicular cargo loaded on the pallet or a retracted position in which multiple pallets may be stacked for shipping.

BACKGROUND OF THE INVENTION

In order to transport a variety of large-sized cargo, it is conventional to load the goods on a pallet capable of supporting such consumer goods, with conventional pallets having a substantially planar support surface for receiving the item. Once the cargo is loaded onto the pallet, the pallet is transported via a loading vehicle (such as a forklift) to the desired means for long distance transportation, such as a truck, ship, train or plane. The conventional pallets that are used for shipping are typically wooden pallets, which are also known as skids. A problem with these skids is that the wood is subject to damage, and therefore the skids are not suitable for carrying cargo on more than a few trips. Additionally, the use of these skids also provides an environmental concern. More specifically, once these skids are no longer usable, they must be discarded and replaced. Since the skids have a short life span, users simply throw the skids away when they can no longer be used. Moreover, since the skids are commonly used for shipping, many landfills will not allow users to discard these wooden pallets to avoid overfilling the landfill.

In attempt to avoid the problems of these wooden pallets, other pallet designs, using a metal or other durable material, have been created for shipping. These pallets are designed to be reused, and the owner of the pallet often desires that the pallet be returned to the origination after use. A problem with these pallet designs is that these pallets are typically quite large and bulky in order to be capable of supporting cargo weighing several tons. As a result, it is difficult to return these pallets to their owners. Moreover, another problem typically arising with conventional pallet designs is that they cannot be secured to each other or stacked upon each other. This makes transportation of the stacks and their cargo difficult and less efficient.

While there are a plurality of patents that disclose various pallet designs (for example, U.S. Pat. No. 4,307,985; U.S. Pat. No. 5,644,991; U.S. Pat. No. 5,983,806), none of these designs providing an adequate solution to the various problems at hand for efficiently transporting cargo and allowing the a prompt return of the pallet to its owner.

SUMMARY OF THE INVENTION

It is an object of the present invention to provide a pallet that is able to transport heavy cargo such as vehicles, appliances and other consumers goods.

It is another object of the present invention to provide a pallet that has the strength to store heavy cargo such as vehicles appliances and other consumers goods.

It is a further object of the present invention to provide a pallet that is lightweight to be easily transported when not loaded with cargo.

It is yet a further object of the present invention to provide a pallet that is stackable with large and heavy cargo stored on the pallet.

It is an additional object of the present invention to provide a pallet that may transport cargo from an origination point to a destination.

It is an additional object of the present invention to provide a pallet that can be rearranged to allow easy return of multiple pallets from the destination to the origination point.

These and other objects of the invention are accomplished by a stackable transport pallet as described in the present invention. The stackable transport pallet includes a planar support member having a substantially cloverleaf shape. The planar support member includes four tubular components (a first and second wide frame member and a first and second narrow frame member) that are joined together to form the cloverleaf shape. A pair of lateral bumpers and a pair of longitudinal bumpers are additionally connected to the planar support member, such that the lateral and longitudinal bumpers will provide a distance between the planar support member and the ground surface, thereby providing a means by which a forklift can raise the planar support member.

The stackable transport pallet additionally includes a set of cargo braces that are operable to support and lock a vehicle or other item being stored on the stackable transport pallet. In addition, a set of leg assemblies are also attached to the planar support member to allow the pallet to be stackable. The leg assemblies are pivotable between an extended and a retracted position. In the extended position, cargo may be loaded on the planar support member. In contrast, when the leg assemblies are in the retracted position, the stackable transport pallets are easily stacked upon each other in large groups such that the stackable transport pallets are easily shipped to a desired destination.

These and other objects and advantages of the invention will become apparent from the following detailed description of the preferred embodiment of the invention

BRIEF DESCRIPTION OF THE DRAWINGS

A stackable transport pallet incorporating the features of the present invention is depicted in the accompanying drawings which form portion of this disclosure and wherein.

DESCRIPTION OF THE PREFERRED EMBODIMENT

Figure 1:
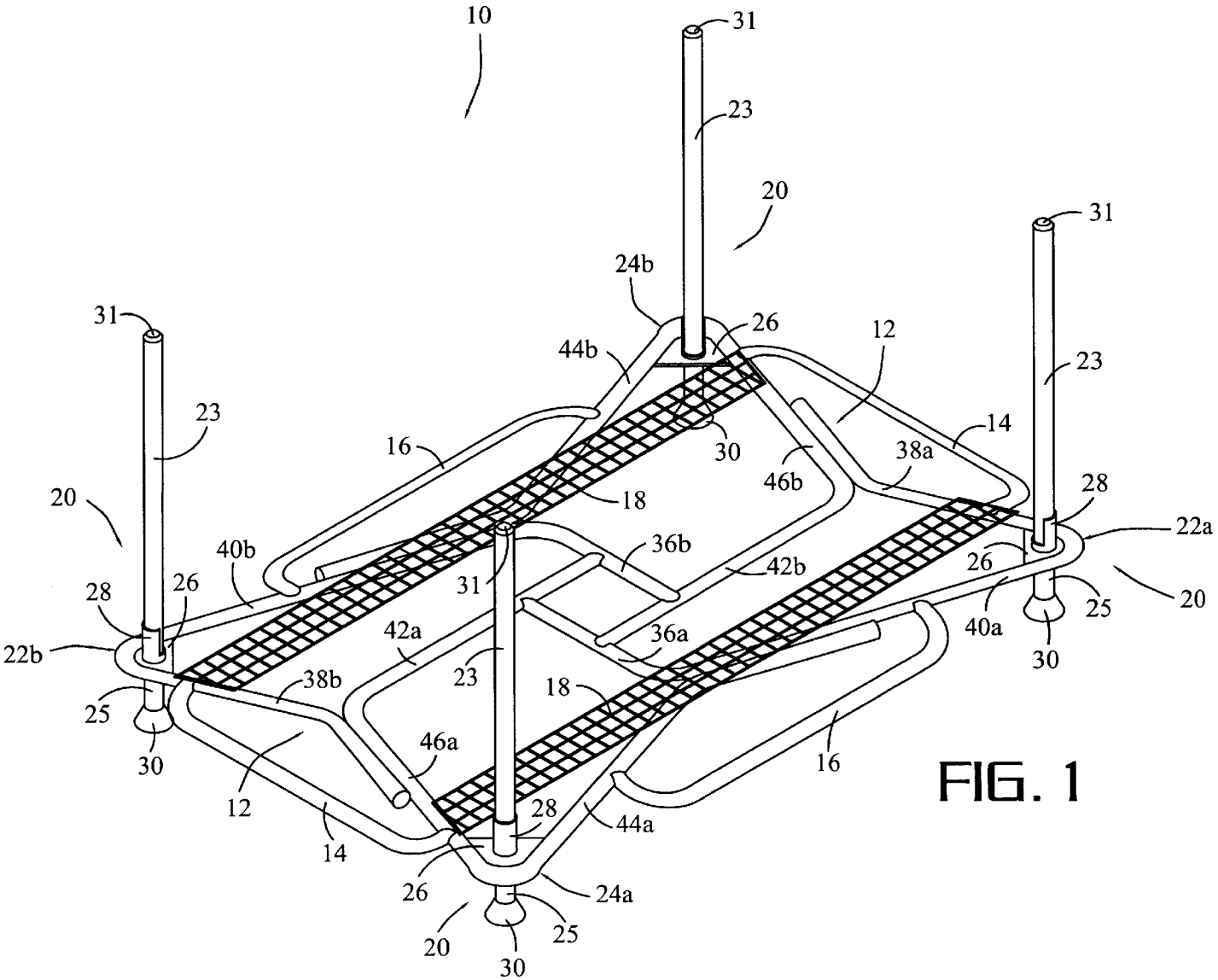
FIG. 1 is a top perspective view of the stackable transport pallet of the present invention, the leg member members of the stackable transport pallet being in the extended position.
Figure 2:
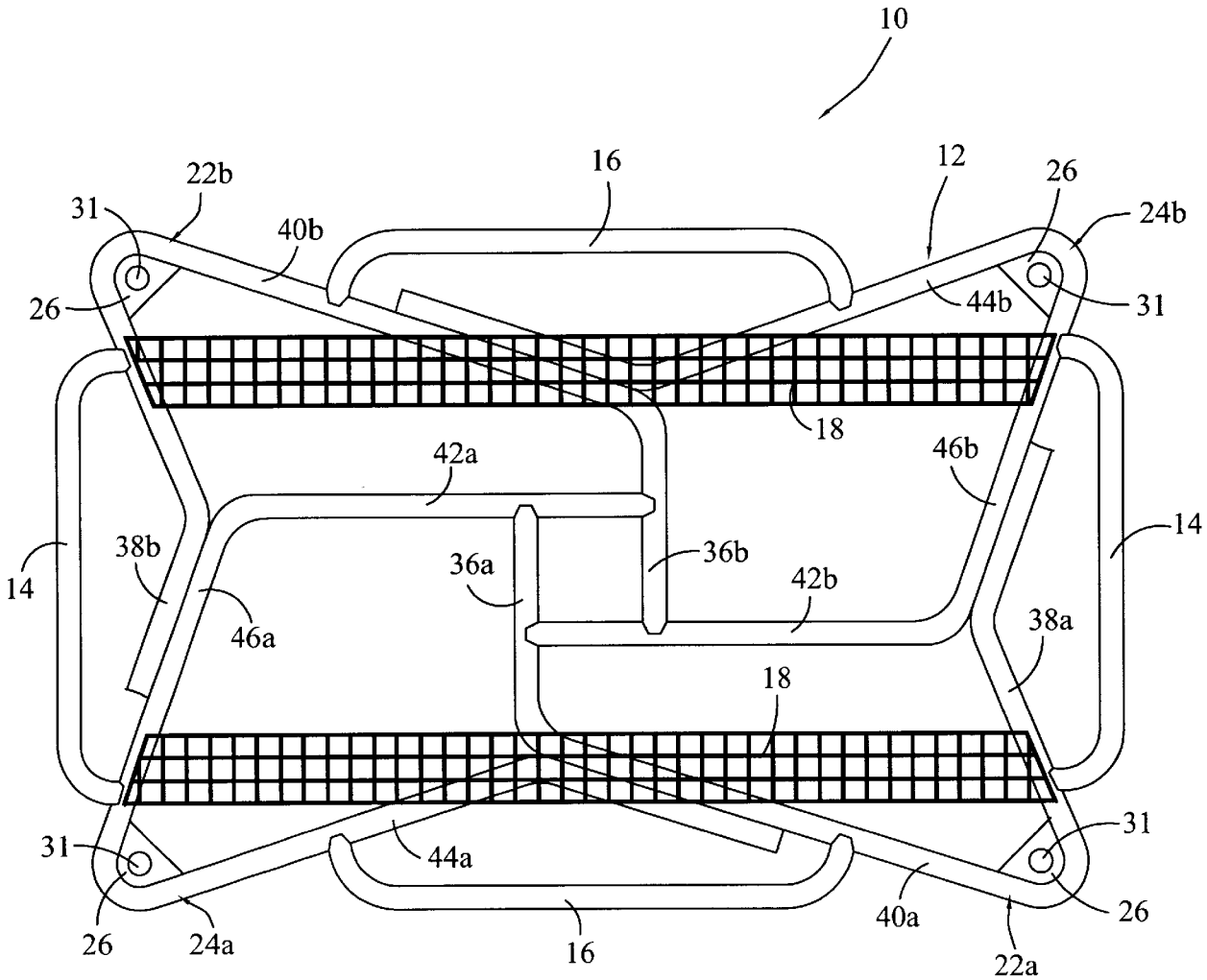
FIG. 2 is a top plan view of the stackable transport pallet of the present invention, the leg member members of the stackable transport pallet being in the extended position.

Looking at FIGS. 1 and 2, the stackable transport pallet 10 of the present invention is illustrated. In general, the stackable transport pallet 10 includes a planar support member 12 having a substantially cloverleaf shape. The planar support member 12 includes four tubular members that are joined together to support the cargo: a first and second wide frame member 22*a*, 22*b* and a first and second narrow frame member 24*a*, 24*b*. The stackable transport pallet 10 additionally includes two lateral bumpers 14 and two longitudinal bumpers 16 that are connected to the planar support member 12. A set of braces 18 are also attached to the planar support member 12, with the braces 18 operable to fasten and support a vehicle or other item being stored on the stackable transport pallet 10. Moreover, a set of leg assemblies 20, preferably four, are also provided in the present invention, with one leg assembly 20 connected to each arcuate corner of the planar support member 12.

Figure 10:
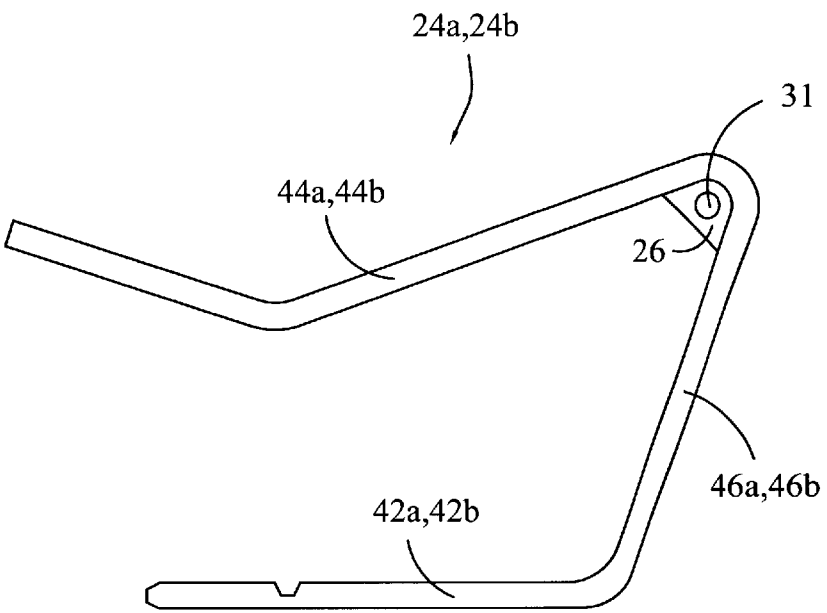
FIG. 10 is a top plan view of a narrow frame member of the stackable transport pallet of the present invention.
Figure 9:
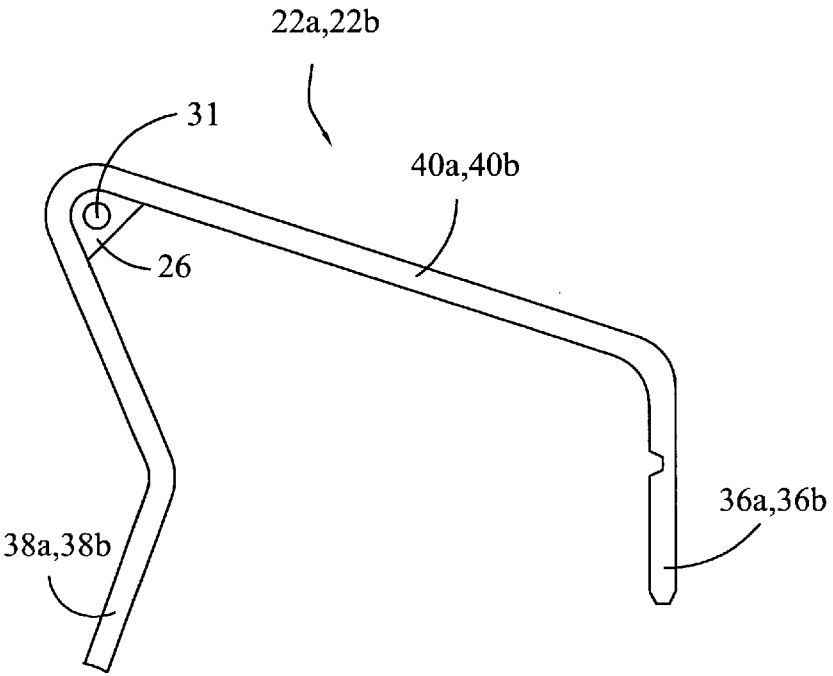
FIG. 9 is a top plan view of a wide frame member of the stackable transport pallet of the present invention.

Looking now to FIG. 2, the planar support member 12 of the stackable transport pallet 10 comprises four tubular members for supporting cargo: two wide frame members 22*a*, 22*b* and two narrow frame members 24*a*, 24*b*. Each frame member 22*a*, 22*b*, 24*a*, 24*b* is rigidly connected with the other frame members 22*a*, 22*b*, 24*a*, 24*b* to create the cloverleaf shape that provides the strength to support the generously proportioned cargo that is to be loaded on the transport pallet 10. In building the cloverleaf design, the two wide frame members 22*a*, 22*b* are positioned diagonally with respect to each other and the two narrow frame members 24*a*, 24*b* are positioned diagonally with respect to each other as well. Looking now to FIGS. 9 and 10, the individual wide frame members 22*a*, 22*b* and narrow frame members 24*a*, 24*b* are illustrated, with each frame member 22*a*, 22*b*, 24*a*, 24*b* preferably being made of a rigid tube or cylinder that is fashioned into a partial rhomboidal shape having arcuate corners. More particularly, looking at FIG. 9, each wide frame member 22*a*, 22*b* has a partial rhomboidal shape defining an inner arm 36*a*, 36*b* that is connected to an external arm 38*a*, 38*b* by a wide coupling arm 40*a*, 40*b*. Looking at FIG. 10, each narrow frame member 24*a*, 24*b* also has a partial rhomboidal shape defining a inner arm 42*a*, 42*b* that is connected to an external arm 44*a*, 44*b* by a narrow coupling arm 46*a*, 46*b*. While the wide frame members 22*a*, 22*b* have a shape similar to the narrow frame members 24*a*, 24*b*, it is clear from a comparison of the wide frame members 20*a*, 20*b* and the narrow frame members 24*a*, 24*b* that the wide coupling arm 40*a*, 40*b* has a greater length than the narrow coupling arm 46*a*, 46*b* (see FIGS. 1, 9, and 10). Moreover, it should be noted that the junction between each external arm 38*a*, 38*b*, 44*a*, 44*b*, and the respective attached coupling arm 40*a*, 40*b*, 46*a*, 46*b* forms an arcuate corner in each respective frame member 22*a*, 22*b*, 24*a*, 24*b*.

Referring back to FIGS. 2, 9, and 10, the planar support member 12 is constructed as follows. Each inner arm 36*a*, 36*b*, 42*a*, 42*b* is connected to one of the other inner arms 36*a*, 36*b*, 42*a*, 42*b* in the subsequent manner: the free end of inner arm 36*a* is connected to an offset point of inner arm 42*a*; the free end of inner arm 42*a* is further connected to an offset point of inner arm 36*b*; the free end of 36*b* is further connected to an offset point of inner arm 42*b*; and the free end of inner arm 42*b* is further connected to an offset point of inner arm 36*a*. Furthermore, each external arm 38*a*, 38*b*, 44*a*, 44*b* preferably has a V-shape to allow the desired connections to complete the construction of the planar support member 12. More specifically, external arm 38*a* is joined with the narrow coupling member 46*b*; external arm 44*b* is joined with the wide coupling member 40*b*; external arm 38*b* is joined with narrow coupling member 46*a*; and external arm 44*a* is joined with wide coupling member 40*a*. It should further be noted that there are many means by which to connect the frame members 22*a*, 22*b*, 24*a*, 24*b* described above, with the preferred method having the frame members 22*a*, 22*b*, 24*a*, 24*b* welded together to provide a rigid and strong planar support member 12. In view of these connections between the frame members 22*a*, 22*b*, 24*a*, 24*b*, the planar support member 12 is created in the desired cloverleaf design, with the cloverleaf design providing the strength and rigidity that is required for storing and transporting the cumbersome cargo on the stackable transport pallet 10.

Figure 3:
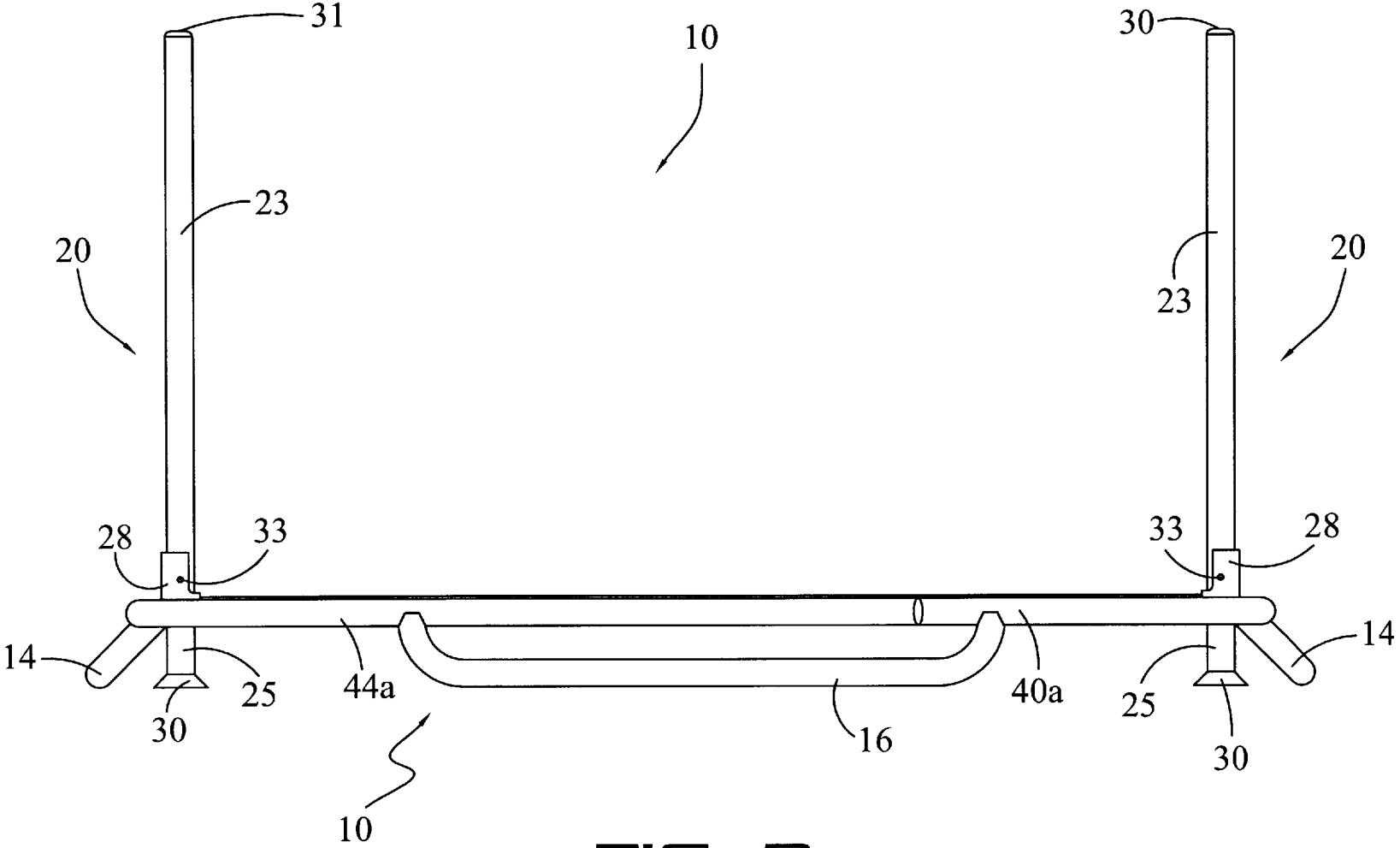
FIG. 3 is a side elevational view of the stackable transport pallet of the present, the leg member members of the stackable transport pallet being in the extended position.
Figure 4:
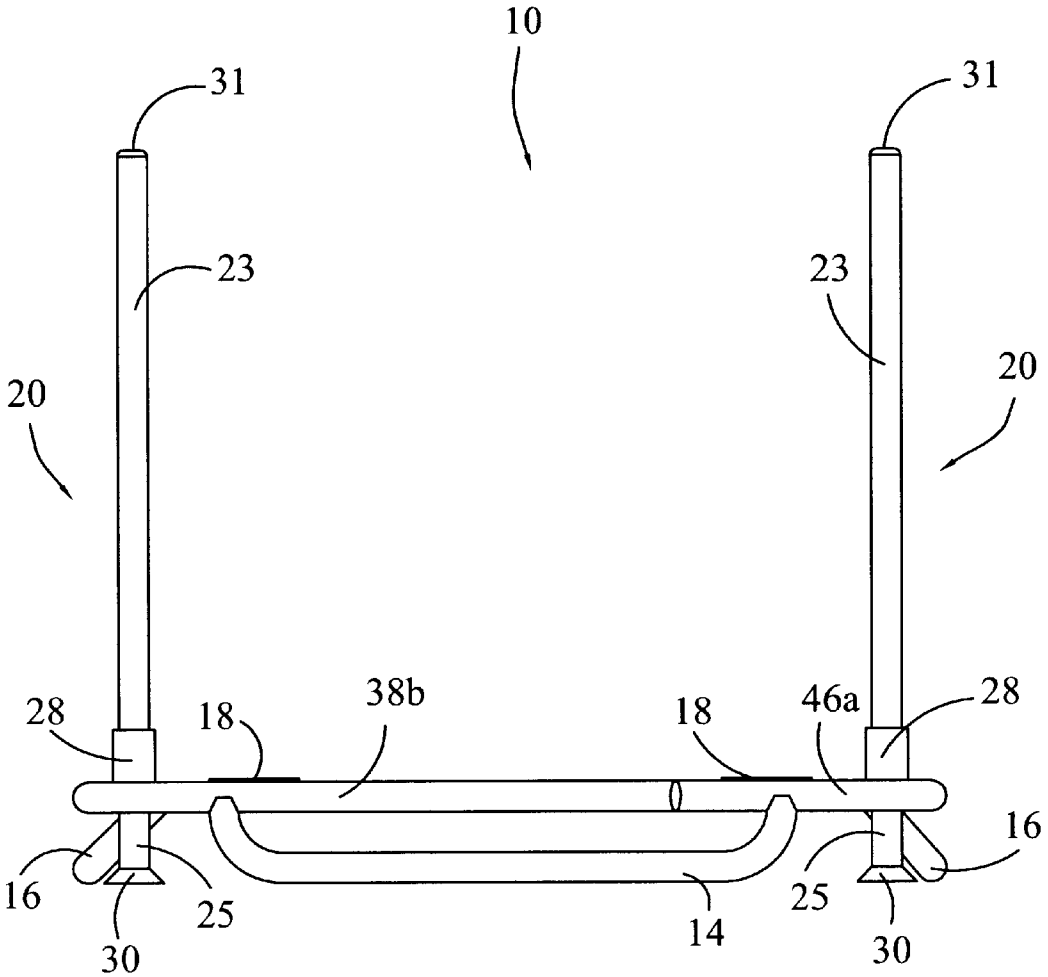
FIG. 4 is a front elevational view of the stackable transport pallet of the present invention, the leg member members of the stackable transport pallet being in the extended position.

Looking at FIGS. 1, 3, and 4, two lateral bumpers 14 are rigidly attached to the planar support member 12. One end of a first lateral bumper 14 is connected to the external arm 38*b* of wide frame member 22*b*, while the opposing end of this first lateral bumper 14 is connected to the narrow coupling arm 46*a* of narrow frame member 24*a*. Similarly, one end of a second lateral bumper 14 is connected to the external arm 38*a* of wide frame member 22*a*, while the opposing end of this second lateral bumper 14 is connected to the narrow coupling arm 46*b* of narrow frame member 24*b*. Each lateral bumper 14 extends diagonally downward from the planar support member 12. The lateral bumpers 14 provide several benefits to the present invention. First, that the lateral bumpers 14 are able to protect the cargo on the stackable transport pallet 10 from undesired contact by foreign items, such as other independent stackable transport pallets 10. In addition, the lateral bumpers 14 are positioned such that they aid in the loading of vehicular cargo; that is, the lateral bumpers 14 act as a partial access ramp so that the vehicle may be driven onto the planar support member 12 with relative ease. Moreover, when the stackable transport pallet 10 is on a ground surface, the lateral bumpers 14 serve as a forklift pocket and allow a forklift or similar vehicle (not illustrated) to engage and lift the planar support member 12, and the lateral bumpers 14 further act as a target for the user in attempting to engage the stackable transport pallet 10. The lateral bumpers 14 also prevent tipping of the stackable transport pallets 10, both while the stackable transport pallet 10 is positioned on a ground surface and also while it is lifted by a forklift.

Figure 11:
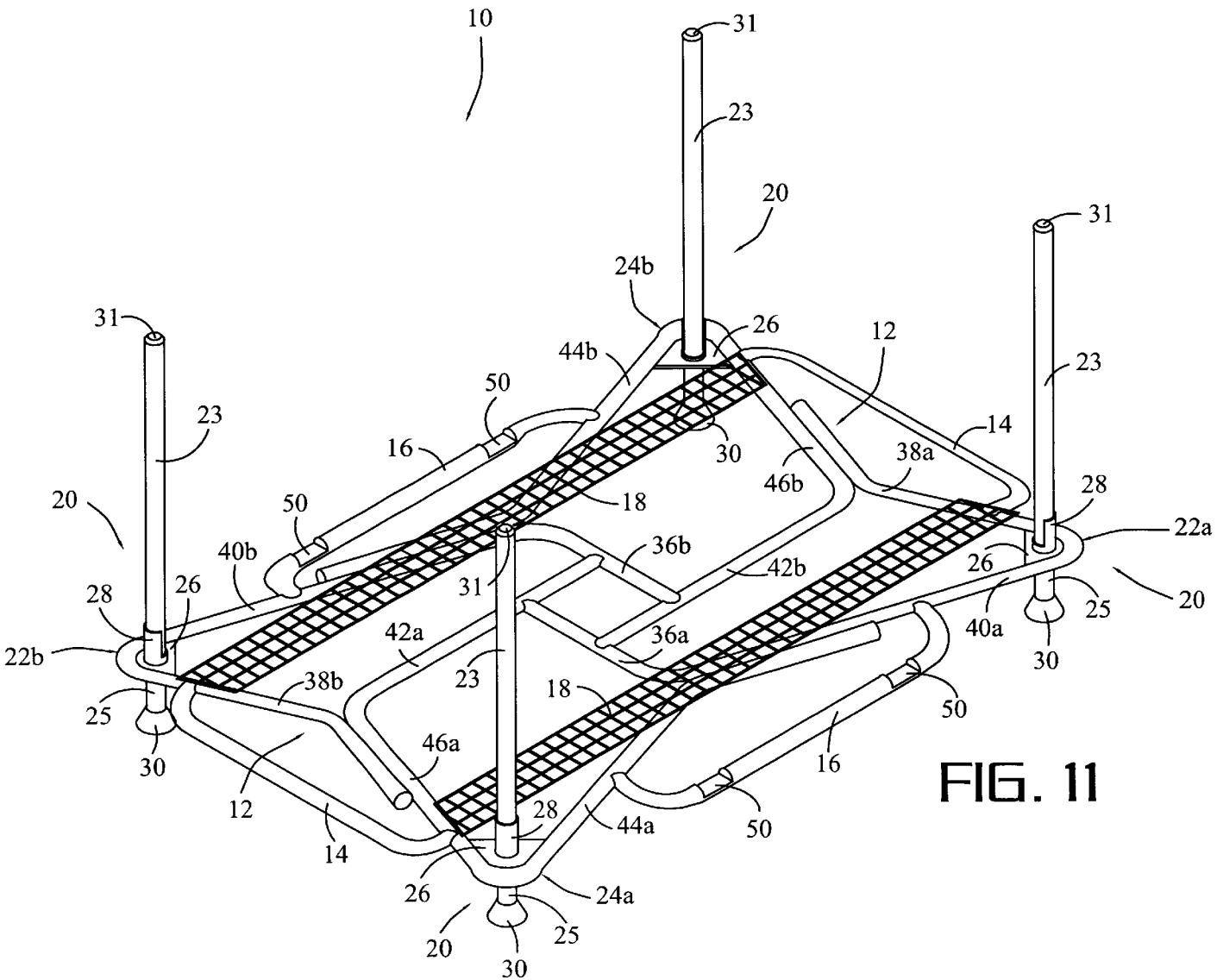
FIG. 11 is a top perspective view of the stackable transport pallet of a second embodiment of the present invention, with the longitudinal bumpers including a series of recessed indentations.

Similarly, the two longitudinal bumpers 16 are rigidly attached to the planar support member 12, as illustrated in FIGS. 1, 3, and 4. One end of a first longitudinal bumper 16 is connected to the external arm 44*a* of narrow frame member 24*a*, while the opposing end of this first longitudinal bumper 16 is connected to the wide coupling arm 40*a* of wide frame member 22*a*. Similarly, one end of a second longitudinal bumper 16 is connected to the external arm 44*b* of narrow frame member 24*b*, while the opposing end of this first longitudinal bumper 16 is connected to the wide coupling arm 40*b* of wide frame member 22*b*. As with the lateral bumpers 14, each longitudinal bumper 16 extends away from the planar support member 12 in a diagonally downward direction such that they are able to protect the cargo on the stackable transport pallet 10 from undesired contact by foreign items, such as other independent stackable transport pallets 10. In addition, the longitudinal bumpers 16 allow a forklift or similar vehicle to engage and lift the planar support member 12, and the longitudinal bumpers 16 further act as a target for the user in attempting to engage the stackable transport pallet 10. Looking at FIG. 11, the longitudinal bumpers 16 may additional include a pair of recessed indentations 50 that allow the wheels of certain forklifts to easily traverse the longitudinal bumpers 16 to engage the stackable transport pallet 10.

As stated above, a pair of braces 18 are included in the present design for supporting the cargo. The braces 18 can be one of several embodiments, with the preferred embodiment including a pair of grids or brackets. The braces 18 are preferably made of an unyielding material that is in the form of a substantially rectangular pattern of lattice. The braces 18 of the preferred embodiment comprise a quadrilateral grid or lattice, and are mounted to the planar support member 12 and extend across the planar support member 12 in a direction perpendicular to the lateral bumpers 14. The braces 18 are attached to the planar support member 12 such that vehicular cargo can be driven onto the braces 18 for simple positioning of the cargo on the stackable transport pallet 10. Moreover, the lattice pattern provided with the braces 18 of the preferred embodiment allows the user to easily lock the cargo to the stackable transport pallet 10. Additionally, the distance between the two braces 18 on the planar support member 12 is typically provided such that a conventional vehicle can be supported on the stackable transport pallet 10. Nonetheless, the distance between the two braces 18 is variable to correspond with the desired wheel base dimension for the cargo to be shipped.

The leg assemblies 20 of the present invention can further be seen clearly in FIGS. 1, 3, and 4. Each leg assembly 20 is affixed to one of the arcuate corners of the planar support member 12 via a gusset 26. The gusset 26 is preferably mounted each arcuate corner of the planar support member 12 to support the leg assembly 20 and reinforce the planar support member 12. Looking at FIG. 5, each leg assembly 20 includes a pipe 23, preferably hollow, having a cap 31, a mounting cylinder 25, a support sleeve 28, and a conical foot 30. The mounting cylinder 25 is transversely positioned through the gusset 26, with the support sleeve 28 attached to one end of the mounting cylinder 25 while the conical foot 30 is attached to the opposing end of the mounting cylinder 25. A securing slot 35 is cut into one end of the pipe 23, with a securing pin 33 mounted to the support sleeve 28 and traversing the securing slot 35.

Figure 6:
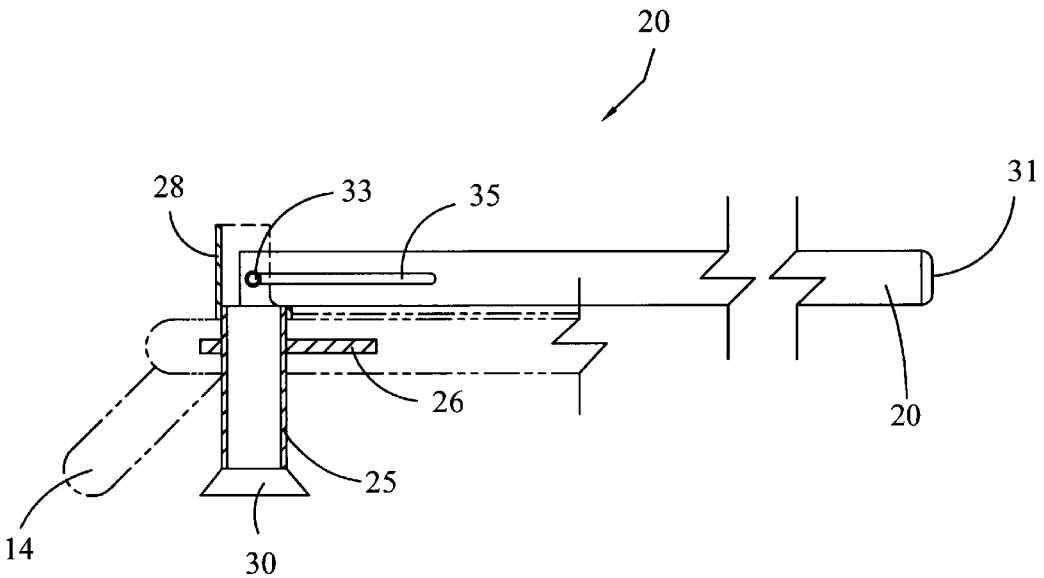
FIG. 6 is a sectional view of one leg member of the stackable transport pallet of the present invention, the leg member being in the retracted position.
Figure 5:
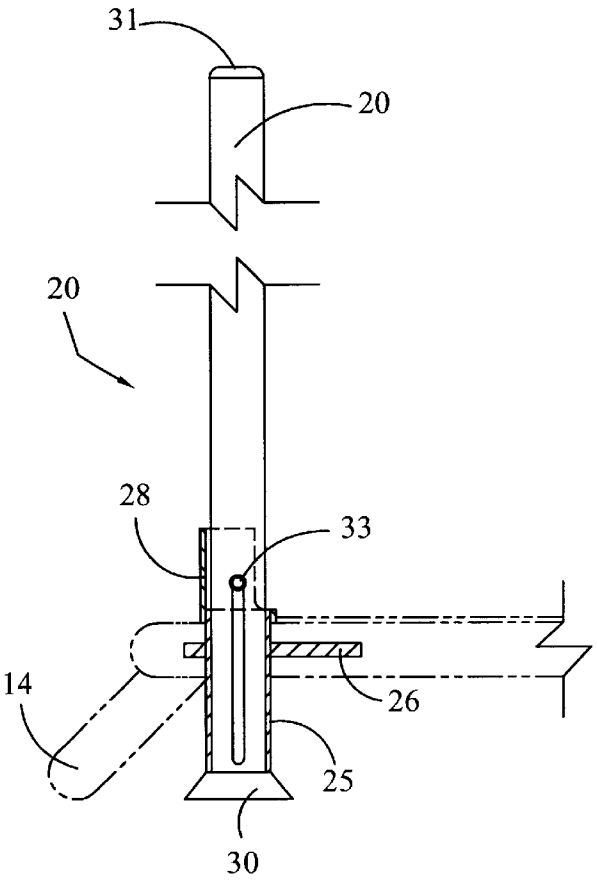
FIG. 5 is a sectional view of one leg member of the stackable transport pallet of the present invention, the leg member being in the extended position.

Looking to FIGS. 5 and 6, each pipe 23 of the leg assembly 20 may be slid relative to securing pin 33 such that the pipe 23 may be pivoted between an extended position (see FIG. 5) and a retracted position (see FIG. 6). In the extended position, the pipe 23 is slid into the mounting cylinder 25 such that the pipe 23 is substantially perpendicular to the planar support member 12. In contrast, the pipe 23 may also be pivoted into a retracted position. In the retracted position, the pipe 23 is pivoted relative to securing pin 33 such that it is removed from the mounting cylinder 25 and positioned substantially parallel to the planar support member 12.

Figure 7:
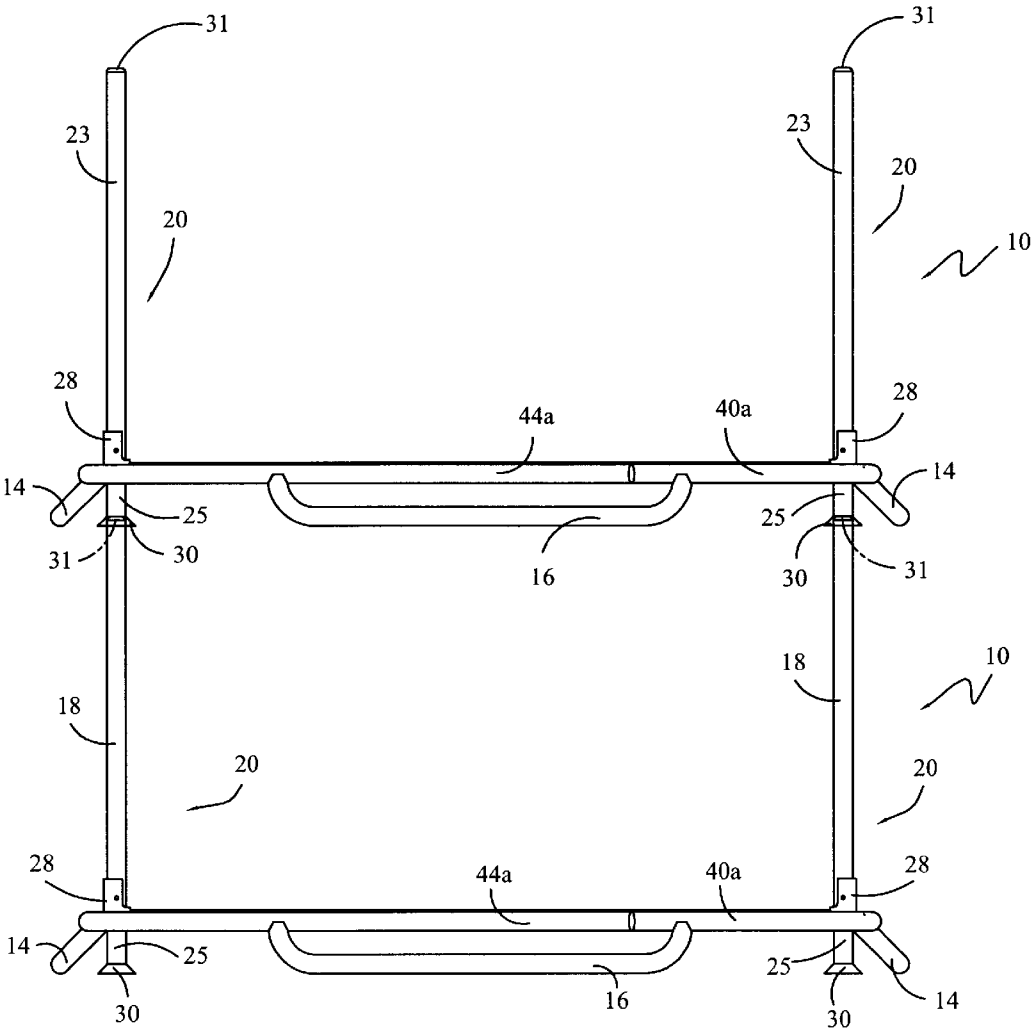
FIG. 7 is a side elevational view of the stackable transport pallet of the present invention illustrating one extended stackable transport pallet stacked on a second stackable transport pallet.

The pipes 23 of the stackable transport pallet 10 are positioned in the extended position when a cargo item is to be stored or transported on the stackable transport pallet 10. Each pipe 23 is designed to be a length that is at least as tall as the item being positioned on the stackable transport pallet 10. As a result, one stackable transport pallet 10 may be stacked upon another stackable transport pallet 10 as illustrated in FIG. 7. More precisely, the conical foots 30 of one stackable transport pallet 10 are designed with an inner surface that is securely positionable on the caps 31 of the pipes 23 of the second stackable transport pallet 10. In such a position, the second stackable transport pallet 10 will not engage the item loaded on the first stackable transport pallet 10.

Figure 8:
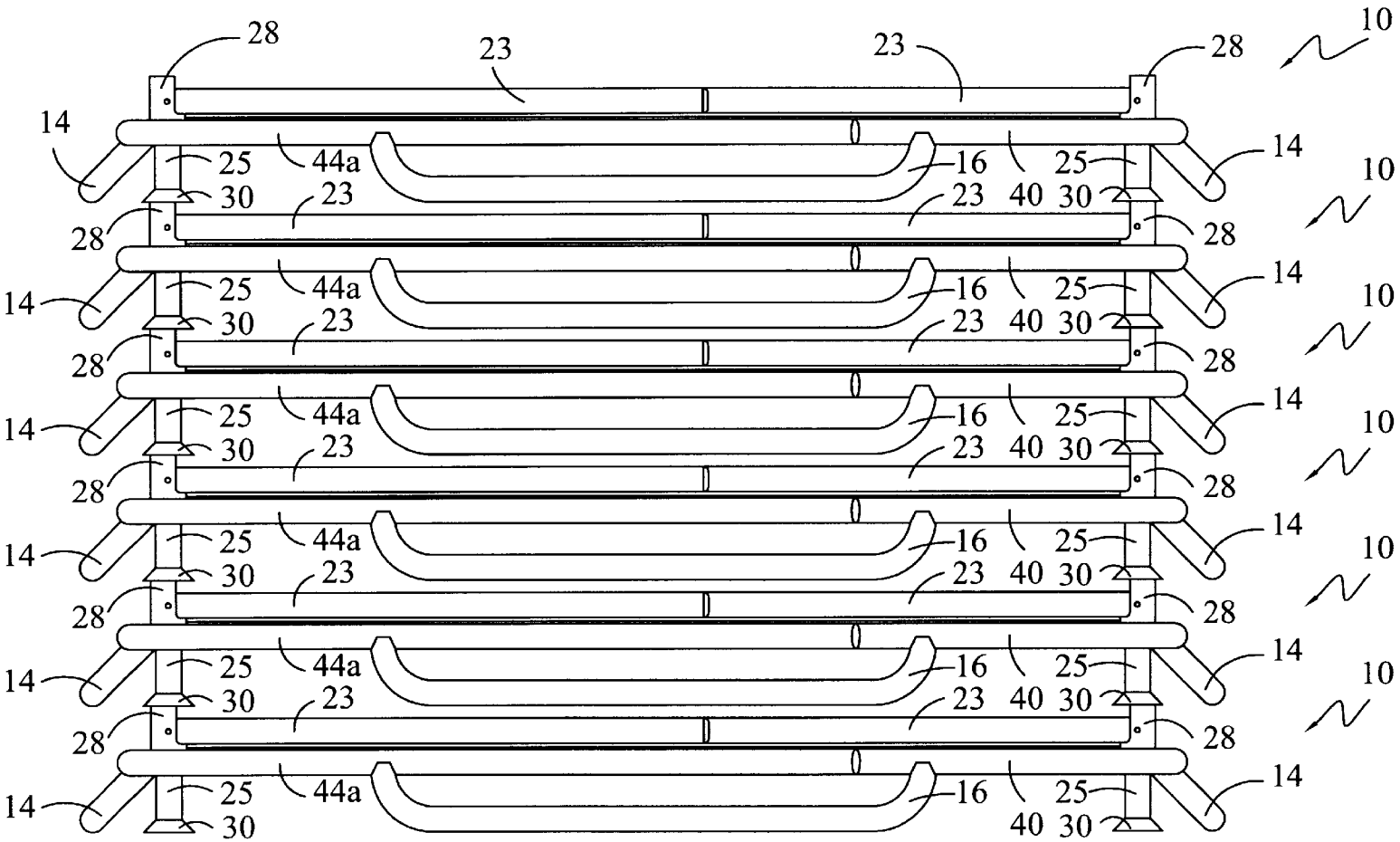
FIG. 8 is a side elevational view of the stackable transport pallet of the present invention illustrating one retracted stackable transport pallet stacked on a second retracted stackable transport pallet.

Conversely, the leg members 20 of the stackable transport pallet 10 are arranged in the retracted position when there is no cargo to be stored or transported on the stackable transport pallet 10. In the retracted position, the pipes 23 engage the securing pin 33 mounting cylinder 25 such that they are positioned parallel to the planar support member 12. As a result, the space occupied by the stackable transport pallet 10 is reduced, and multiple stackable transport pallets 10 may be stacked upon each other without occupying a significant amount of space (see FIG. 8). It should further be noted that if the leg assemblies 20 are in the retracted position, the support sleeves 28 of the second stackable transport pallet 10 will engage the conical foots 30 of the first stackable transport pallet 10, which further allows for multiple stackable transport pallets 10 to be stacked upon each other. Since a plurality of stackable transport pallets 10 may be stacked together, the group of stackable transport pallets 10 may be relocated in relatively easy fashion.

In addition to the advantages stated above, the stackable transport pallet 10 of the present invention also provides several other benefits for shipping and storing cargo. First, up to five stackable transport pallets 10 may be stacked on top of each other when the leg assemblies 20 are in the extend position, which aids in the storage of the cargo. In operation, the stackable transport pallets 10 are stacked two-high to fit the space inside of a conventional truck. Moreover, when the leg assemblies 20 are retracted, approximately six of the retracted stackable transport pallets 10 may be stacked on each other in the same amount of space as one stackable transport pallet 10 with the leg assemblies 20 extended. Consequently, the stackable transport pallets 10 in the extended position may be used to transport goods and then they may be retracted for easy return to the origination location.

Additionally, it is important to note that the interlocking tubular geometry of this design maximizes strength for transporting cargo at the four-corners and the midsection. This design further minimizes the material needed to support larger payloads that are heavy and cumbersome. Each lateral and longitudinal bumper 14, 16 reinforces the planar support member 12 and allows for idler roller conveyance commonly used by shippers. The variable nature of this cloverleaf configuration in a square or rectangular format to allow for a wide variety of types of cargo. Moreover, while the tubular members of the planar support member 12 are durable, they are also lightweight and easy to fabricate, such that they are more economical to produce than conventional pallets or crates. Additionally, the stackable transport assembly 10 may be configured to the size desired for the type of cargo desired to be transported.

Moreover, the modular construction of the stackable transport assembly 10 provides for simple replacement of any parts of the stackable transport assembly 10 should any damage or abuse occur to the modular components. For example, the pipes 23 of the leg assemblies 20 may easily be removed and replaced by simply removing the securing pin 33 from the leg assembly 20. In addition, the weight to strength ratio of the present design is very high. For example, the stackable transport assembly 10 of the present invention can hold an estimated 2,500 pounds safely and securely, while the components of the present invention weigh only approximately 107 pounds collectively.

Thus, although there have been described particular embodiments of the present invention of a new and useful STACKABLE TRANSPORT PALLET, it is not intended that such references be construed as limitations upon the scope of this invention except as set forth in the following claims.

What is claimed is:

1. A pallet for use in transporting and storing vehicles comprising:

a planar support member comprising four tubular members, said four tubular members defining four corners;

a plurality of gussets, each said gusset attached to one said corner of said planar support member; and a plurality of leg assemblies attached to one said gusset of said planar support member, each said leg assembly comprising:

a pipe having a distal and a proximal end, said pipe pivotally attached to one said gusset and pivotable between an extended position and a retracted position; and a foot attached to said proximal end of said pipe, said foot supporting said planar support member.

2. The pallet as described in claim 1 wherein said tubular members of said planar support member comprise:

a first and second wide frame member, said first and second wide frame member each including an inner arm, an external arm and a wide coupling arm connecting said inner arm and said external arm; and a first and second narrow frame member, said first and second narrow frame member each including an inner arm, an external arm and a narrow coupling arm connecting said inner arm and said external arm.

3. The pallet as described in claim 2 wherein:

said inner arm of said first wide frame member is connected to said inner arm of said first narrow frame member;

said inner arm of said first narrow frame member is connected to said inner arm of said second wide frame member;

said inner arm of said second wide frame member is connected to said inner arm of said second narrow frame member;

said inner arm of said second narrow frame member is connected to said inner arm of said first wide frame member;

said external arm of said first wide frame member is connected to said narrow coupling arm of said second narrow frame member;

said external arm of said first narrow frame member is connected to said wide coupling arm of said first wide frame member;

said external arm of said second wide frame member is connected to said narrow coupling arm of said first narrow frame member; and said external arm of said second narrow frame member is connected to said wide coupling arm of said second wide frame member.

4. The pallet as described in claim 2 further comprising a lateral bumper having a first and second end, said first end of said lateral bumper connected to said external arm of said second wide frame member and said second end of said lateral bumper connected to said narrow coupling arm of said first narrow frame member.

5. The pallet as described in claim 4 further comprising a second lateral bumper having a first and second end, said first end of said second lateral bumper connected to said narrow coupling arm of said second narrow frame member and said second end of said second lateral bumper connected to said external arm of said first wide frame member.

6. The pallet as described in claim 2 further comprising a longitudinal bumper having a first and second end, said first end of said longitudinal bumper connected to said external arm of said first narrow frame member and said second end of said longitudinal bumper connected to said wide coupling arm of said first wide frame member.

7. The pallet as described in claim 6 further comprising a second longitudinal bumper having a first and second end, said first end of said second longitudinal bumper connected to said external arm of said second narrow frame member and said second end of said longitudinal bumper connected to said wide coupling arm of said second wide frame member.

8. The pallet as described in claim 1 further comprising a pair of braces attached to said planar support member.

9. A stackable transport pallet for transporting cargo comprising:

a planar support member having four corners, said planar support member comprising:

a first and second wide frame member, said first and second wide frame members each including an inner arm, an external arm and a wide coupling arm connecting said inner arm and said external arm; and a first and second narrow frame member, said first and second narrow frame members each including an inner arm, an external arm and a narrow coupling arm connecting said inner arm and said external arm;

a plurality of gussets, each said gusset attached to one said corner of said planar support member; and a plurality of leg assemblies, each said leg assembly attached to one said gusset of said planar support member.

10. The stackable transport pallet as described in claim 9 wherein said inner arm of said first wide frame member is connected to said inner arm of said first narrow frame member;

said external arm of said first wide frame member is connected to said narrow coupling arm of said second narrow frame member;

said inner arm of said first narrow frame member is connected to said inner arm of said second wide frame member;

said external arm of said first narrow frame member is connected to said wide coupling arm of said first wide frame member;

said inner arm of said second wide frame member is connected to said inner arm is of said second narrow frame member;

said external arm of said second wide frame member is connected to said narrow coupling arm of said first narrow frame member;

said inner arm of said second narrow frame member is connected to said inner arm of said first wide frame member; and said external arm of said second narrow frame member is connected to said wide coupling arm of said second wide frame member.

11. The stackable transport pallet as described in claim 9 wherein each said leg assembly comprises:

a pipe having a distal and a proximal end, said pipe pivotally attached to one said gusset and pivotable between an extended position and a retracted position; and a foot attached to said proximal end of said pipe, said foot supporting said planar support member.

12. The pallet as described in claim 9 further comprising a lateral bumper having a first and second end, said first end of said lateral bumper connected to said external arm of said second wide frame member and said second end of said lateral bumper connected to said narrow coupling arm of said first narrow frame member.

13. The pallet as described in claim 12 further comprising a second lateral bumper having a first and second end, said first end of said second lateral bumper connected to said narrow coupling arm of said second narrow frame member and said second end of said second lateral bumper connected to said external arm of said first wide frame member.

14. The pallet as described in claim 9 further comprising a longitudinal bumper having a first and second end, said first end of said longitudinal bumper connected to said external arm of said first narrow frame member and said second end of said longitudinal bumper connected to said wide coupling arm of said first wide frame member.

15. The pallet as described in claim 14 further comprising a second longitudinal bumper having a first and second end, said first end of said second longitudinal bumper connected to said external arm of said second narrow frame member and said second end of said longitudinal bumper connected to said wide coupling arm of said second wide frame member.

16. The pallet as described in claim 1 further comprising a pair of braces attached to said planar support member.

17. A stackable transport pallet for transporting cargo comprising:

a planar support member having four corners, said planar support member comprising:

a first and second wide frame member, said first and second wide frame members each including an inner arm, an external arm and a wide coupling arm connecting said inner arm and said external arm; and a first and second narrow frame member, said first and second narrow frame members each including an inner arm, an external arm and a narrow coupling arm connecting said inner arm and said external arm, said frame members connected in the form of a cloverleaf with said wide frame members diagonally disposed relative to each other and said narrow frame members diagonally disposed relative to each other; and, a plurality of positional leg assemblies, each said leg assembly attached proximal one corner of said planar support member.

* * * * *